United States Patent [19]

Jansen et al.

[11] Patent Number: 4,691,806

[45] Date of Patent: Sep. 8, 1987

[54] APPARATUS FOR TAKING UP AND PLAYING OUT LINES

[76] Inventors: Norman A. Jansen, 18965 S. Pear Rd., Oregon City, Oreg. 97045; Beryl D. Randall, 4025 NE. 109th Ave., Portland, Oreg. 97220

[21] Appl. No.: 747,379

[22] Filed: Jun. 21, 1985

Related U.S. Application Data

[63] Continuation of Ser. No. 529,952, Sep. 6, 1983, abandoned.

[51] Int. Cl.[4] ..... B66B 9/20; A62C 35/00; B65H 75/34

[52] U.S. Cl. ..... 187/9 R; 242/47.5; 414/918; 137/355.17; 137/355.23

[58] Field of Search ..... 242/47.5; 137/355.16, 137/355.17, 355.2, 355.23, 355.24, 355.25; 414/918; 187/9 E, 9 R

[56] References Cited

U.S. PATENT DOCUMENTS

| | | | |
|---|---|---|---|
| 1,384,153 | 7/1921 | Roos | 242/47.5 |
| 1,864,891 | 6/1932 | Coberly et al. | 242/47.5 |
| 2,026,327 | 12/1935 | Sparling | 137/355.25 X |
| 2,214,759 | 9/1940 | Bosch, Jr. | 242/47.5 |
| 2,225,859 | 12/1940 | Cox | 137/355.25 |
| 2,503,018 | 4/1950 | Wittman | 242/47.5 |
| 2,724,520 | 11/1955 | Overbeck | 414/918 X |
| 2,730,183 | 1/1956 | Svoboda | 242/47.5 X |
| 2,736,445 | 2/1956 | Hoban | 414/918 X |
| 3,612,318 | 10/1971 | Ramsey | 242/47.5 X |
| 4,174,816 | 11/1979 | Olson | 242/47.5 |

FOREIGN PATENT DOCUMENTS

| | | | |
|---|---|---|---|
| 2838702 | 3/1979 | Fed. Rep. of Germany | 137/355.17 |
| 442660 | 11/1948 | Italy | 137/355.25 |
| 442556 | 2/1936 | United Kingdom | 242/47.5 |
| 631827 | 11/1949 | United Kingdom | 137/355.25 |

*Primary Examiner*—Stanley N. Gilreath
*Attorney, Agent, or Firm*—Klarquist, Sparkman, Campbell, Leigh & Whinston

[57] ABSTRACT

The invention comprises a mechanism for playing out and taking up a loop of an elongated, flexible line, such as an electrical power cable or a hydraulic hose line to maintain tension in the loop. More specifically, a housing is provided within which at least one loop of line is positioned. A traveling member within the housing engages the loop and slides in one direction to play out portions of the loop from the housing and in a second direction to take up portions of the loop within the housing. This traveling member is biased in the second direction so that the apparatus automatically takes up slack in the lines.

6 Claims, 7 Drawing Figures

APPARATUS FOR TAKING UP AND PLAYING OUT LINES

This application is a continuation of application Ser. No. 529,952 filed Sept. 6, 1983, now abandoned.

BACKGROUND OF THE INVENTION

1. Field of the Invention

The present invention relates to devices for taking up and playing out lines so as to maintain tension in the lines. These devices are used in applications such as handling hydraulic hoses and electrical power cables which power movable masts and attachments of a forklift.

2. Description of the Prior Art

Previously, spring loaded hose reels have typically been used to take up slack in forklift hydraulic hoses and electrical cables. These reels rotate in one direction to take up slack and in the other direction to play out hose.

These hose reels suffer from a number of disadvantages. For example, they are typically mounted to the mast of a forklift, or to the front supporting framework of the forklift. In such positions, the devices interfere with the visibility of the operator. This endangers the safety of workers adjacent to the vehicles. In some instances, these devices have been mounted in an upright or vertical orientation to the overhead guards or roofs of forklifts. Such mounting, although eliminating the visibility problems, interferes with the operation of the forklift in situations where vertical clearance is limited. For example, vertical clearance is tight when forklifts are driven into railroad cars for loading and unloading operations. Also, hose reels are connected by couplings to hydraulic hose sections, such couplings being subject to leaking. Also, hose reels are comprised of relatively numerous costly parts. The number of parts, together with the rugged environment in which these devices are often used, increases the maintenance required to keep hose reels functional. Furthermore, because the devices typically project outwardly from the supporting surface of a forklift and have a high profile, they are subject to being hit and damaged.

Another prior hose or cable handling apparatus utilizes a counter-weighted sheave. These devices suffer from many of the problems mentioned above. For example, they are typically mounted along the sides of the mast or vehicle framework, impairing the vision of the vehicle operator. Furthermore, they are relatively noisy.

Therefore, a need exists for an improved device for handling hydraulic hoses, power cables, and other flexible lines which is directed toward overcoming these and other problems of previously existing devices.

SUMMARY OF THE INVENTION

In its broadest aspects, the invention comprises a means for playing out and taking up a loop of an elongated, flexible line, such as an electrical power cable or a hydraulic hose line to maintain tension in the loop. More specifically, a housing is provided within which at least one loop of line is positioned. A traveling means within the housing engages the loop and slides in one direction to play out portions of the loop from the housing and in a second direction to take up portions of the loop within the housing. This traveling means is biased in the second direction so that the apparatus automatically takes up slack in the lines.

Accordingly, it is one object of the invention to provide an improved apparatus for taking up and playing out lines, such as electrical power cables and hydraulic hoses, used to operate forklift masts and other attachments.

A further object of the invention is to provide an apparatus for taking up and playing out lines which is adapted for mounting to a vehicle in positions which minimize the impairment of the vehicle operator's vision.

Another object of the invention is to provide such an apparatus which is compact in at least one dimension and is capable of being mounted to a roof or overhead guard of a vehicle with this one dimension oriented vertically, so as to minimize the vertical clearance required for the vehicle when the invention is mounted.

Still another object of the invention is to provide such an apparatus which handles one or more continuous loops of flexible hydraulic lines, thereby eliminating leak prone couplings and other breaks in the line.

A still further object of the invention is to provide such an apparatus which is mechanically simple, rugged, easy to install, and which requires a minimum of maintenance.

Another object of the invention is to provide such an apparatus which is versatile, is capable of handling multiple loops of lines, and is adaptable to handle extended lengths of such lines.

These and other objects, features, and advantages of the present invention will become apparent from the following description and drawings.

DETAILED DESCRIPTION OF THE PREFERRED EMBODIMENT

Figure 1:
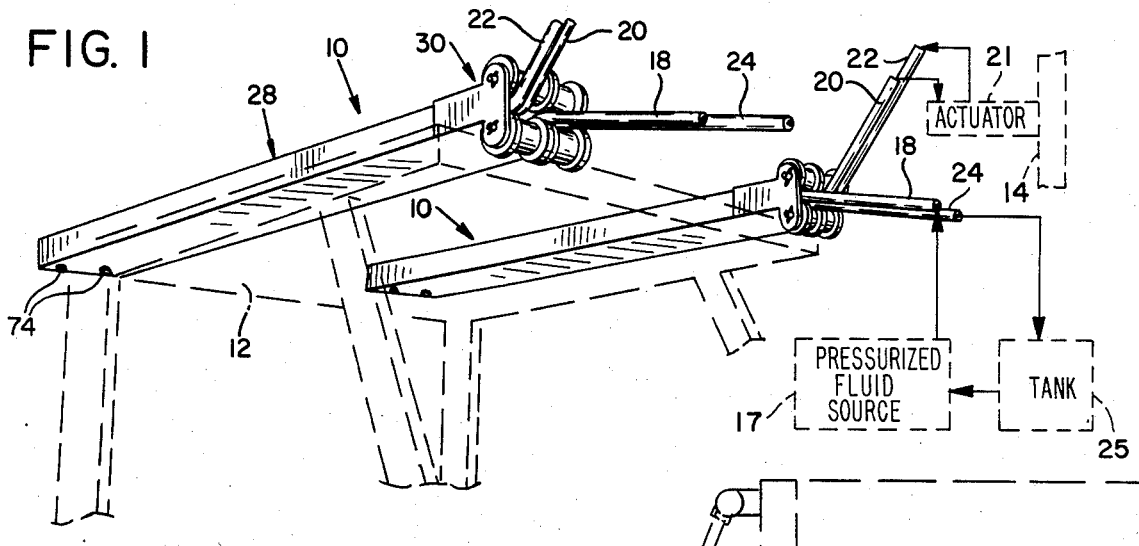
FIG. 1 is a perspective view of a two line handlilng apparatuses in accordance with the invention for taking up and playing out lines, shown mounted to the overhead guard of a forklift and with portions of the forklift shown schematically in dashed lines.
Figure 2:
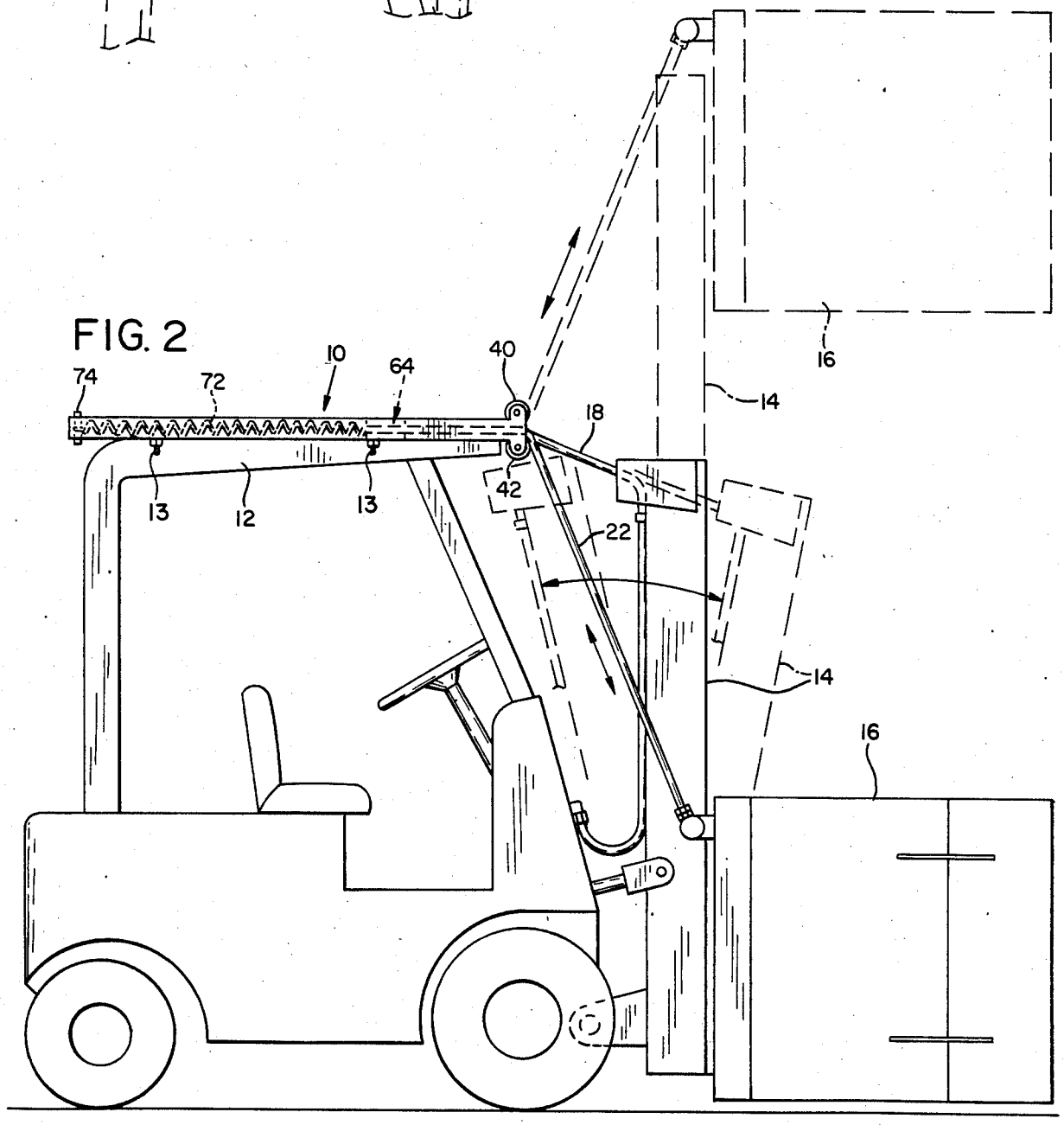
FIG. 2 is a side elevational view of a line handling apparatus of FIG. 1.
Figure 3:
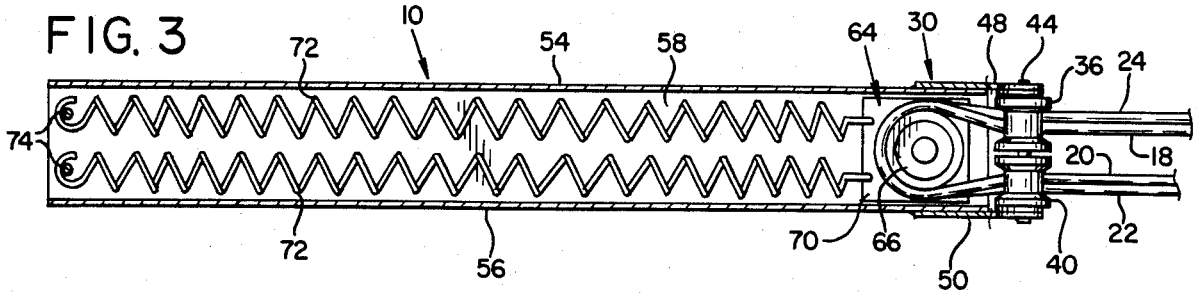
FIG. 3 is a top view of the line handling apparatus of FIG. 1, with a top housing portion broken, and with a traveling member in a position in which lines are substantially played out from the apparatus.
Figure 4:
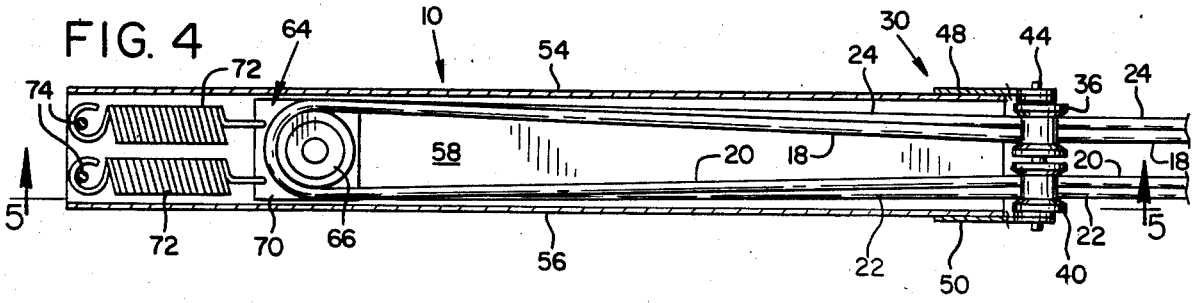
FIG. 4 is a top view of the hose handling apparatus which is identical to FIG. 3, except that the traveling member is in a position in which lines are taken up within the housing.
Figure 5:
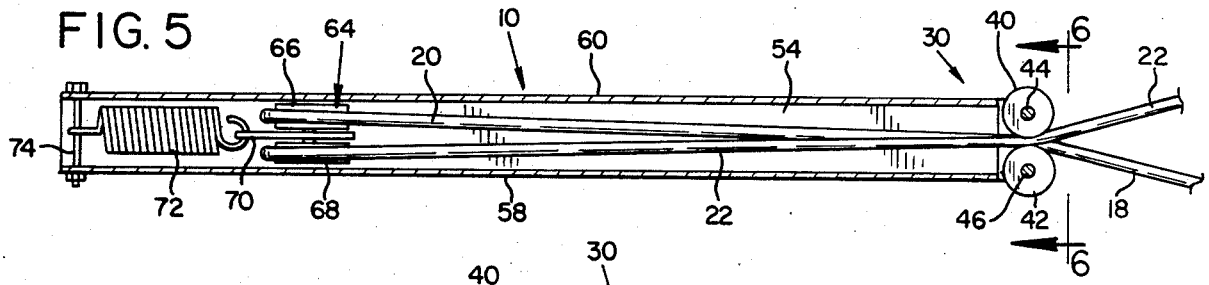
FIG. 5 is a side elevational view of the line handling apparatus of the invention, taken along line 5—5 of FIG. 4.

With reference to FIGS. 1 and 2, a pair of parallel, spaced apart, line handling apparatuses 10 are shown mounted to the overhead guard 12 of a forklift, as by bolts 13. These devices are operable to take up and play out elongated, flexible lines, such as electrical power lines or hydraulic hose lines utilized to power a forklift mast and other forklift attachments. The following description proceeds on the basis that the mechanisms 10 are handling hydraulic hoses and are mounted in the orientation shown. It is to be understood that the devices may be mounted in other orientations as well. In addition, these mechanisms may be mounted to any suitable surfaces of the vehicle, such as to vertical frame components of the vehicle or to the mast.

The illustrated forklift is shown with a hydraulically operated mast 14 which may be raised and lowered. In addition, this forklift is shown with a hydraulic paper roll handling attachment 16 which operates in a conventional manner to grasp and release rolls of paper.

One of the mechanisms 10 handles the hoses associated with the operating mast 14 while the other of the devices holds the hoses associated with the operating paper clamping mechanism 16. For purposes of illustration, the hose sections are numbered 18, 20, 22, and 24 in these figures. Hose sections 18 and 20 are portions of one continuous, unbroken loop of hose which is positioned within the housing, while hose sections 22, 24 form another such loop. Pressurized hydraulic fluid from a source 17 is delivered through hose sections 18, 20 to a hydraulic motor or cylinder or actuator 21 which raises and lowers the mast. Fluid from this cylinder or motor passes through the hose sections 22, 24 to a hydraulic fluid tank 25 mounted on the vehicle. Similar hose sections 18–24 are provided for delivering and returning hydraulic fluid to and from the paper clamping mechanism 16.

As the mast 14 is raised and lowered, or tilted forward or backward, the mechanisms 10 play out and take up portions of the loops of hoses so as to maintain the hoses taught and prevent them from tangling. Hose is taken up into, and played out from, housing 28 through end portion 30 of the hose handling apparatuses as required.

With reference to FIGS. 3 through 6, housing 28 is of a rectangular box-like construction of steel or other rigid material. The housing includes a planar, platelike base 58 adapted to rest upon a supporting surface such as the overhead guard 12 of a forklift. In addition, the housing includes parallel, laterally spaced apart side walls 54, 56 projecting upwardly from the base 58. A cover plate 60 extends between walls 54, 56 and completes the enclosure. One end 30 of the housing is open for receiving loops of hose. Hose within the housing is protected from being cut or damaged by falling debris. Roller supporting cheek plates 48, 50 are welded or otherwise fastened to the respective sidewalls 54, 56 to project forwardly of the ends of these sidewalls.

Figure 6:
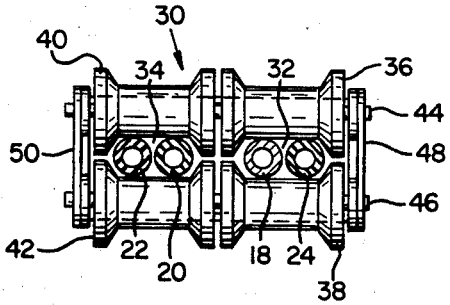
FIG. 6 is an end view of the line handling apparatus of the invention, taken along line 6—6 of FIG. 5.

As shown in FIG. 6, respective sets of upper and lower rollers 36, 38 and 40, 42 are positioned at end 30 of the housing for guiding hose as it passes in and out of the housing. The set of rollers 36, 38 define a first opening 32 within which side-by-side hose sections 18, 24 pass. In addition, the rollers 40, 42 define a second opening 34 through which side-by-side hose sections 20, 22 pass. The rollers 36, 40 are pivoted by a pin 44 to the cheek plates 48, 50. In addition, the rollers 38, 42 are pivoted by a pin 46 to these cheek plates, as well. With this construction, the rollers guide the movement of the hose sections inwardly into and outwardly from the interior of the housing. In addition, these rollers separate the open end of the housing into two hose receiving openings which separate hose sections 18, 24 from the hose sections 20, 22. This minimizes the chance of sections 18, 24 binding and tangling with hose sections 20, 22 as they traverse the path through the housing.

A traveling member of block 64 is slidably received within the housing and is movable toward and away from the end 30. As block 64 moves toward end 30, hose is played out from the housing. Conversely, as block 64 moves away from end 30, hose is taken up into the housing. Upper and lower hose guiding means, such as pulleys 66, 68 are pivoted to the respective upper and lower surfaces of a plate 70 which forms a part of the traveling block. The loop of hose including sections 18, 20 pass around the upper pulley 66 while the loop comprised of sections 22, 24 pass around the pulley 68. The plate 70 helps separate the loops from one another in the event they slip off their respective pulleys.

A biasing mechanism is provided for automatically taking up slack hose into the housing. This biasing mechanism may comprise coil springs 72 each fastened at one end to plate 70 and at their other end to pins 74 which are in turn mounted to the housing. This biasing mechanism retracts or moves the traveling block 64 away from end 30 to take up slack hose within the housing.

In operation, as the mast is raised or tilted forward, tension is applied to the ends of the loops of hose which are positioned within the housing. This moves the traveling block 64, against the bias of springs 72, toward end 30 of the apparatus. As a result, hose is played out from the apparatus as required to accommodate the movement of the mast. The springs 72 maintain tension in these hoses. As the mast is retracted or lowered, the traveling block 64 is moved by springs 72 in the opposite direction away from end 30. This takes up hose within the housing. Thus, the pathway along which the hose is positioned within the housing, around the traveling block 64, is respectfully shortened to play hose out from the housing, and lengthened to take up hose within the housing.

Figure 7:
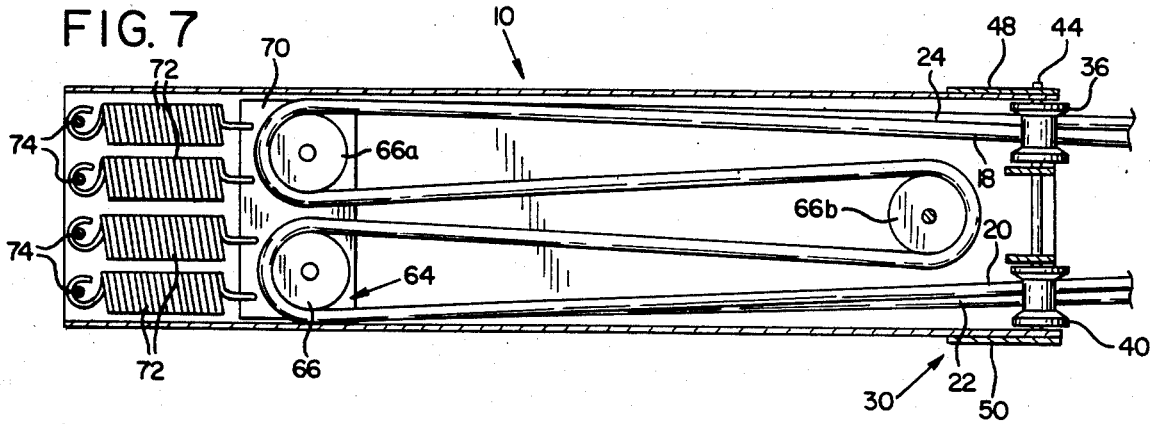
FIG. 7 is a top view of an alternate embodiment of a line handling apparatus in accordance with the invention, with a top portion of the housing removed.

The embodiment of FIG. 7 illustrates how the apparatus may be easily modified to take up and play out additional lengths of hose within the housing. In this embodiment, the traveling block 64 is modified to support an additional set of upper and lower pulleys. The upper pulley of this set is numbered **66*a* in FIG. 7. In addition, still another set of upper and lower pulleys, including an upper pulley 66*b*, is positioned adjacent the end 30 of the housing. Instead of the loop making one pass from the opening to the traveling block and back to the opening, a multi-pass serpentine pathway is provided. That is, considering hose sections 18 and 20, hose section 18 enters its opening between the rollers, passes around pulley 66*a*, passes around the fixed pulley 66*b* passes around pulley 66, and exits from the housing as hose section 20. It should be noted that, in a similar manner, any number of passes may be provided to add additional length to the amount of hose which may be retracted within and played out from the housing. Furthermore, it would be a fully equivalent construction to mount the set of pulleys, which include pulley 66*b*, to a spring biased traveling block, with the springs tied to end 30 of the housing. At the same time, the sets of pulleys which include pulleys 66 and 66*a* would be fixed. In this case, the set of pulleys including pulley 66*b* would move away from end 30 to play out hose from the housing and toward end 30** to retract hose within the housing.

Therefore, an extremely efficient, rugged, compact, and reliable hose handling apparatus results.

Having illustrated and described the principles of our invention with reference to several preferred embodiments, it should be apparent to those persons skilled in the art that such invention may be modified in arrangement and detail without departing from such principles. We claim as our invention all such modifications as come within the true spirit and scope of the following claims.

We claim:

1. In a forklift vehicle, the improvement comprising in combination:

a vehicle body having a roof or overhead support members;

a movable mast mounted to the body;

an actuator mounted to the mast and operable in response to hydraulic or electrical power;

at least one elonaged flexible line, such as an electrical power line or hydraulic hose lines, coupled from the body to the actuator;

line handling attachment means mounted to the roof or overhead support members so as to be above and out of the forward field of vision of an operator of the vehicle, the line handling attachment means comprising:

an elongated housing defining a line receiving opening through which at least one loop of line may be passed;

traveling means within the housing for engaging a loop of the line which is passed into the housing through the line receiving opening, said traveling means being slidable relative to the housing for movement in a first direction which plays out a length of the loop through the line receiving opening and for movement in a second direction which takes up a length of the loop through the line receiving opening; and biasing means mounted to the housing and coupled to said traveling means for biasing said traveling means in the second direction to take up slack in the loop.

2. In a forklift vehicle, the improvement comprising in combination:

a vehicle body having a roof or overhead support members;

a movable member coupled to the body for movement relative to the body;

a source of electricity or pressurized hydraulic fluid on the body;

an actuator mounted to the movable member and operable in response to electricity or pressurized hydraulic fluid from the source;

at least one elongated flexible power or hydraulic fluid line coupled from the source to the actuator;

an attachment means for taking up and playing out the at least one elongated flexible line, the flexible line extending from the source to the movable member, along the movable member and then to the attachment means and from the attachment means to the actuator, the attachment means comprising:

an elongated hollow housing means mounted to the roof or overhead support members, the housing means having first and second openings for receiving at least one loop of the flexible line extending between the first and second openings, the movable member and thus the actuator being movable relative to the first and second openings, one segment of the loop passing through the first opening and another segment of the loop passing through the second opening, the portions of the line adjacent to the first and second openings being freely movable relative to the housing as the movable member of the vehicle moves, said first and second openings each loosely receiving the line such that the line is freely slidable in either direction through each of the first and second openings as the movable member of the vehicle moves;

traveling block means slidably positioned within the housing for engaging a loop of a line within the housing means, said traveling block means being slidable in a first direction to shorten the length of the loop within the housing means and thereby play out line from the housing means through said first and second openings and being slidable in a second direction to lengthen the length of the loop within the housing and thereby take up line through said first and second openings within the housing means; and means for biasing said traveling block means in the second direction such that said traveling block means moves to take up slack in the loop.

3. An apparatus according to claim 1 in which said traveling means includes pulley support plate means having first and second sidewalls, first pulley means pivoted to said first sidewall, and second pulley means pivoted to said second sidewall, such that a first loop of a line may be engaged and guided by the first pulley means and a second loop of a line may be engaged and guided by the second uplley means, said pulley support plate means holding the first and second loops apart in the region of said pulley means.

4. An apparatus according to claim 3 in which said first and second pulley means each pivot about a respective axis normal to the direction of the longitudinal axis of said housing.

5. An apparatus according to claim 3 in which said biasing means comprises coil spring means mounted to said housing and to said traveling block means.

6. A method of taking up and playing out an elongated flexible electrical power line or hydraulic hose line from a source of electricity or pressurized hydraulic fluid to an electric or hydraulic actuator of a forklift or other vehicle, the vehicle having a body with a roof, the source being carried by the body, the vehicle also having a movable member mounted to the body and carrying the actuator, comprising:

passing the lines from the source to the roof of the vehicle and from the roof of the vehicle to the actuator;

forming a loop in the line on the roof of the vehicle;

increasing the size of the loop to take up line onto the roof of the vehicle; and decreasing the size of the loop to play out line from the roof of the vehicle.

* * * * *